US005205765A

United States Patent [19]

Holden

[11] Patent Number: 5,205,765

[45] Date of Patent: Apr. 27, 1993

[54] BOAT HULL AND PROPULSION SYSTEM OR THE LIKE

[75] Inventor: Joseph T. Holden, Houston, Tex.

[73] Assignee: The Pinnacle Corporation, Houston, Tex.

[21] Appl. No.: 618,495

[22] Filed: Nov. 27, 1990

[51] Int. Cl.[5] ..... B63H 11/02

[52] U.S. Cl. ..... 440/66; 440/38

[58] Field of Search ..... 114/356, 56; 440/49, 440/66, 68, 38, 47, 82; 416/223 R

[56] References Cited

U.S. PATENT DOCUMENTS

| | | | |
|---|---|---|---|
| 1,667,561 | 4/1928 | Mediavilla | 114/356 X |
| 2,630,094 | 3/1953 | Hacker | 440/82 |
| 2,812,738 | 11/1957 | Munro | 440/68 |
| 3,138,130 | 6/1964 | Morgan | 440/68 X |
| 3,367,423 | 2/1968 | Van Ranst | 416/223 R |
| 3,438,350 | 4/1969 | Gallin | 114/56 |
| 4,505,684 | 3/1985 | Holden et al. | 440/68 X |

*Primary Examiner*—Edwin L. Swinehart

*Attorney, Agent, or Firm*—Browning, Bushman, Anderson & Brookhart

[57] ABSTRACT

A device, such as a boat hull and propulsion system, for effecting relative movement of a flowable substance, such as water. A channel having open upstream and downstream ends at least partially defines a flow path. The channel includes a fully laterally closed core section distal the upstream end with a fluid moving rotor rotatably mounted therein and a transition section extending forward from the upstream end of the core section. The channel configuration and rotor are adapted to permit a continual decrease in the transverse cross-sectional area of the flow path downstream along the transition section. If the device is a boat hull, the bow is configured to cause gas lubrication thereof by interaction with the water in motion. The transition sections of the channels may be open-bottomed, and ribs are provided to house drive shafts extending downwardly to the rotors. The bow provides lift, and downwardly facing surfaces adjacent the stern are inclined to balance this lift, so that the boat can rise on the water with an upward translating type movement. The rotors themselves are also improved.

45 Claims, 10 Drawing Sheets

BOAT HULL AND PROPULSION SYSTEM OR THE LIKE

BACKGROUND OF THE INVENTION

1. Field of the Invention

The present invention pertains to systems for effecting relative movement of a flowable substance, more specifically to marine vessels, and even more particularly to hulls and propulsion means for such vessels.

2. Description of the Background

Prior U.S. Pat/ No. 4,505,684 discloses a vessel the hull of which has longitudinally extending, open-ended tubes along its full length. The tubes housed propellers which could propel the vessel by moving water through the tubes. The tubes were configured to effect velocity and pressure changes in the relatively moving water in a manner generally opposite that of a conventional venturi.

This prior art vessel incorporated several features reminiscent of aircraft technology. For example, the aforementioned reverse venturi operation was enhanced by a ramlike effect if the vessel moved through the water at a sufficient speed. Also, the propellers within the longitudinal tubes were further enclosed within shorter rings, reminiscent of shrouds used in ducted fan type thrust systems for jet aircraft.

Another feature of this prior art vessel which differed from conventional marine vessel design was the formation of convergent bow and stern configurations by a series of intersecting flat segments, rather than by smooth curves.

The present invention represents further development of an improvement over the vessel disclosed in prior U.S. Pat. No. 4,505,684. As will be explained more fully below, the present invention increases the potential speed per unit horsepower by several different expedients. The present invention also provides easier access for repair purposes, and even facilitates the potential beaching of certain embodiments for such repairs at low tide.

A particular problem with the prior art vessel was that each tube had to be divided into two laterally spaced apart branches in order to accommodate an engine and shaft to drive the respective propeller. The present invention provides an improved way of interconnecting the engine and rotor, and which also serves several other useful functions, such as enhancement of structural strength.

These and other improvements and developments will be made apparent by the description of the present invention itself.

SUMMARY OF THE INVENTION

One of the ways in which the present invention improves over the above-described prior art is by providing for a much longer transition section of a fluid flowway wherein the transverse cross-sectional area continually decreases in the downstream direction to a point slightly upstream of the propeller or rotor. This enhances the reverse venturi and ram effects.

In large part, this improvement, as well as various other improvements, were made possible by the discovery that it is not necessary for the channel which defines the fluid flowway to be fully laterally closed by physical structure over its entire length in order to cause masses of water to move longitudinally from bow to stern beneath the hull of a boat. In accord with the present invention, only a relatively short core section, beginning at the downstream end of the aforementioned transition section and extending rearwardly at least somewhat past the rotor or propeller, need be fully laterally closed. The transition section can be open at the bottom, and even along the sides, at least to a great extent. This not only does not result in lateral loss of water from the flowway, but when coupled with a proper rotor and operating speed, can actually allow even greater masses of water to be moved. The flowway is, in effect, made much larger at its upstream end than would be practicable with a fully laterally enclosed transition section. This, in turn, helps to allow for the aforementioned varying transverse cross-sectional area over a greater portion of the overall length of the channel which defines the flowway as well as for movement of greater volumes of water.

The open-bottomed structure also eliminates substantial weight, which in turn allows greater speed per unit horsepower, while that speed in turn contributes to the enhanced ram effects, as well as the very ability to make the channels open-bottomed. This interaction between the open-bottomed channel and the speed is one of many examples of synergistic cooperation of the various elements of the invention.

Further contributing to the openness of the structure of the underside of the hull is another aspect of the invention which allows an engine, which drives the rotor, to be located inside the vessel hull and connected to the rotor by a protected shaft, even though the rotor is exposed in an open-ended channel beneath the main undersurface of the hull. Particularly, the hull includes a hollow rib which depends downwardly from the main undersurface and runs longitudinally along the transition section of the channel upstream of the core section. This rib houses the drive shaft, which is angled downwardly and rearwardly, so that it passes from the primary interior usable space of the hull into and through the rib and thence to the rotor. The fact that this rib runs through the center of the channel does not interfere with the function of the channel. On the contrary, the lower face of the rib is inclined generally parallel to the shaft so that it extends from the bottom of the core section upwardly and forwardly to the main undersurface of the hull. Since the depth of the rib increases rearwardly, the rib occupies more and more of the transverse cross-sectional flow area as it progresses rearwardly. The rib, therefore, serves to gradually decrease the transverse cross-sectional flow area along the transition section of the channel, and this in turn enhances the ability to properly form and define the channel without the need for substantial lateral enclosure along the transition section.

In most embodiments of the invention, there will be multiple channels, and thus multiple ribs. This strengthens the hull and contributes to the elimination of the need for a conventional keel, which in turn reduces weight. The inclination of the ribs provides abutment for beaching the vessel, if desired, and along with the largely open structure of the channels, allows repair work to be done, for example on the rotors, on a beach at low tide. This capability is valuable particularly in vessels which may need to be repaired under adverse or primitive circumstances.

The core section of each channel is preferably defined at the top by the main undersurface of the hull, at the bottom by a bottom plate spaced below the undersurface, and at the sides by side plates interconnecting the undersurface and the bottom plate. Preferably, these side plates project forward from the bottom plate to partially define the sides of the transition section of the channel, and their lower edges are preferably inclined upwardly and forwardly.

The bow portion of the hull is formed of a number of flat plates angularly joined to approximate the shape of a streamlined convergent bow curve. When the vessel is in motion, these plates provide lift. Downwardly facing surfaces near the stern of the vessel, such as the lower face of the rib, are inclined at angles designed to balance the bow lift. Thus, as the speed of the vessel increases, it will rise on the water with an upward translational type movement, i.e. without the bow canting up. It will be recognized that, once the vessel has thus risen, there will be less lift area in contact with the water at the bow end of the vessel, but the surfaces providing aft lift will still be submerged. It might be considered that this could then cause the bow to cant downwardly. However, it has been found that, particularly if the undersurface of the hull and the bottom plate are extended rearwardly somewhat beyond the core section, the inertia of the water between these surfaces will prevent such canting. In addition, the vessel accelerates and decelerates rapidly and has excellent maneuverability.

The angularly disposed bow plates, coupled with the speed of movement of the vessel, tend to produce gas lubrication of the bow of the vessel. This effect can be enhanced by properly sizing the angles between the plates. The gas lubrication drastically reduces the resistance, both frictional and drag, of the water to movement of the vessel. Meanwhile, due to the movement of water from bow to stern through the channels, water which would otherwise form a bow wave or wake is moved along the underside of the vessel and used to propel the vessel. This can dramatically increase the speed and performance of the vessel. The side plates of the outermost channels may be extended in length to help retain the lubricating gas so that it continues to flow over and lubricate the entire length of the hull. This extension of the outermost side plates also helps to keep water from falling into the flowways laterally from the sides of the vessel.

The angles of the bow plates can also be sized to help minimize secondary impingement of water, which likewise decreases resistance to the forward movement of the vessel.

Within the core section of the channel and surrounding the rotor is a ring spaced from at least some of the inner surfaces of the core section This provides bypass space through which even greater flow of water can be induced, e.g. by entrainment or pressure differentials, than what is moved by direct interaction with the rotor. The greater the mass of water moved, the greater the thrust for a given horsepower, and also the more complete the elimination of the bow wave.

The rotor itself is also improved. The rotor has blades, preferably four in number, the outer edges of which are deflected in a downstream direction. Although cavitation is not a problem due to the pressurization of the core section just ahead of the rotor, eroding of the metal ring by water flung outwardly by the rotor could be a problem in the absence of this deflected configuration of the blade tips. Contrary to conventional design, the rotor blades each preferably have a rectilinear edge (usually leading) and a curvilinear edge (usually trailing). The blades are adapted to absorb the maximum power output of the engine.

Various objects, features and advantages of the present invention will be made apparent by the following detailed description, the drawings and the claims.

DETAILED DESCRIPTION OF THE PREFERRED EMBODIMENTS

Figure 1:
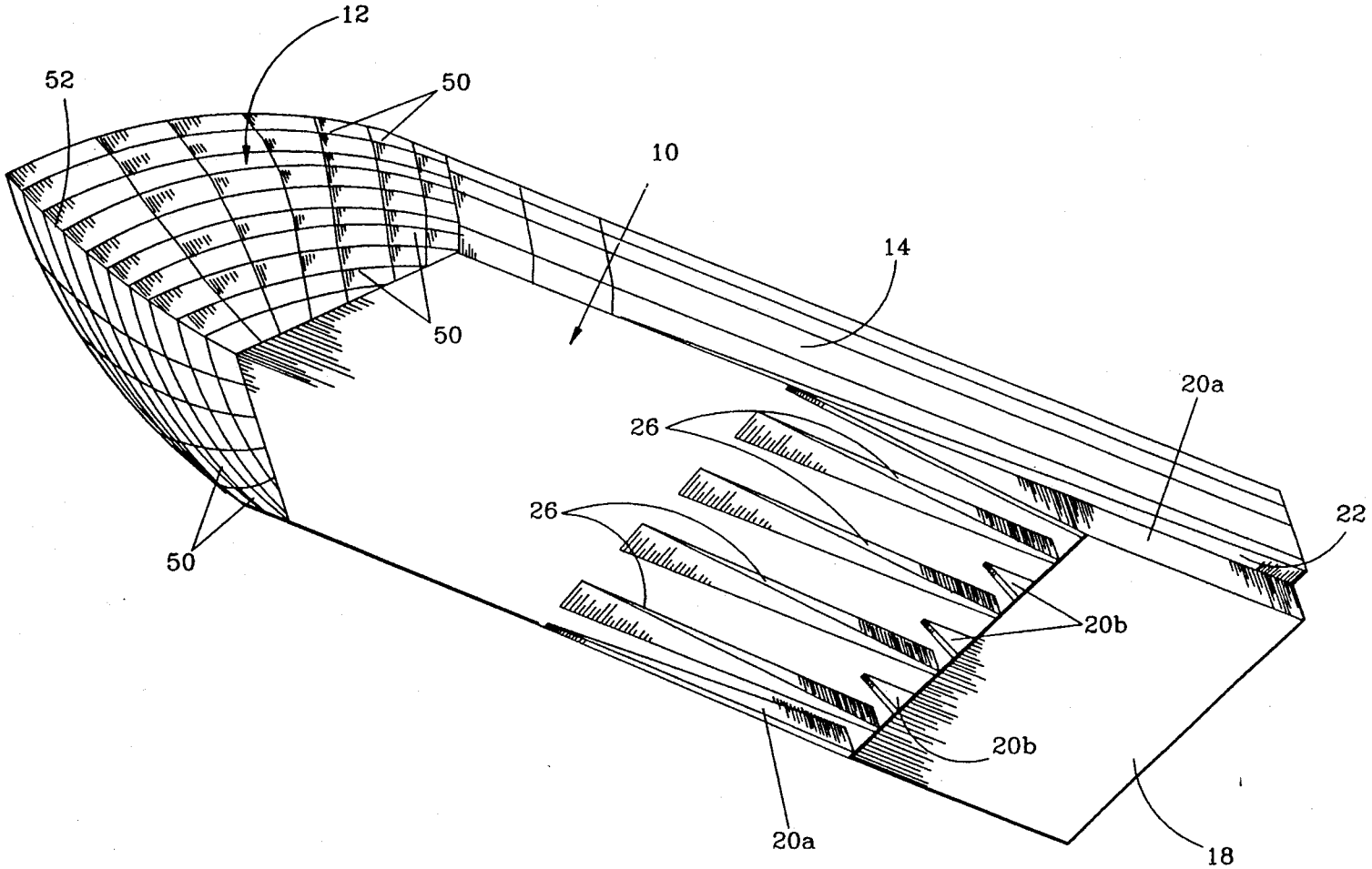
FIG. 1 is a perspective view of a boat hull according to a first embodiment of the invention.
Figure 2:
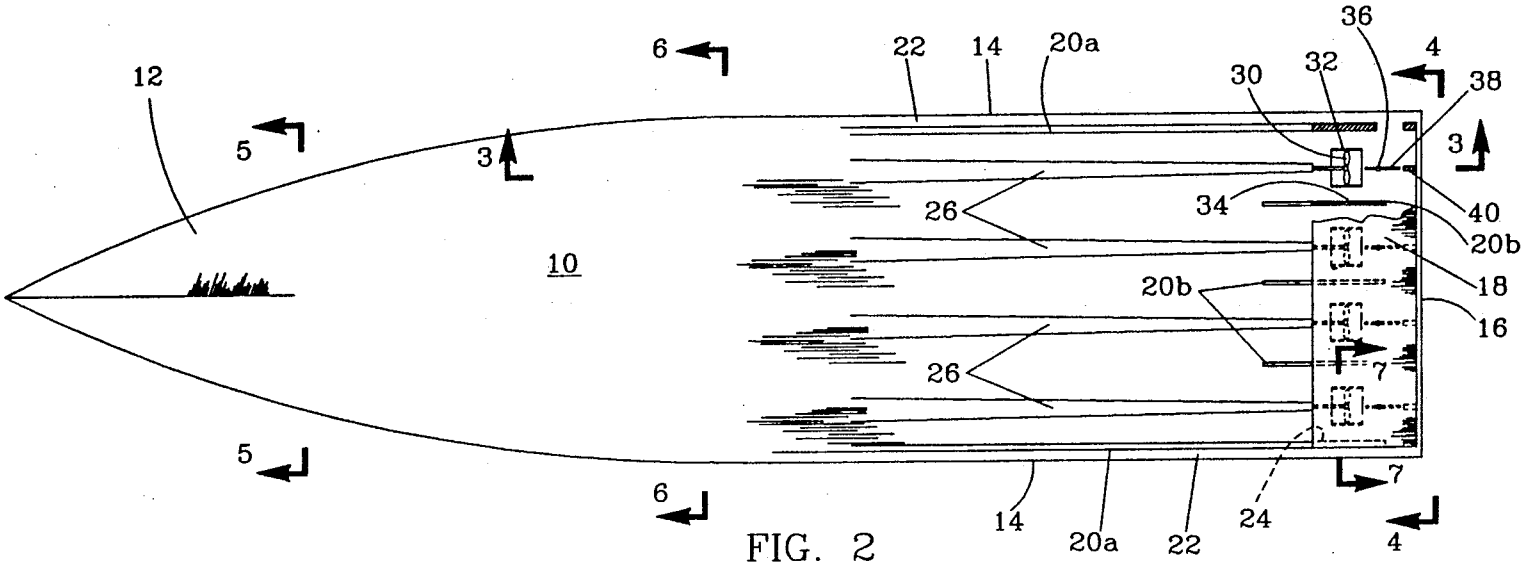
FIG. 2 is a bottom plan view of the embodiment of FIG. 1 with parts broken away.
Figure 3:
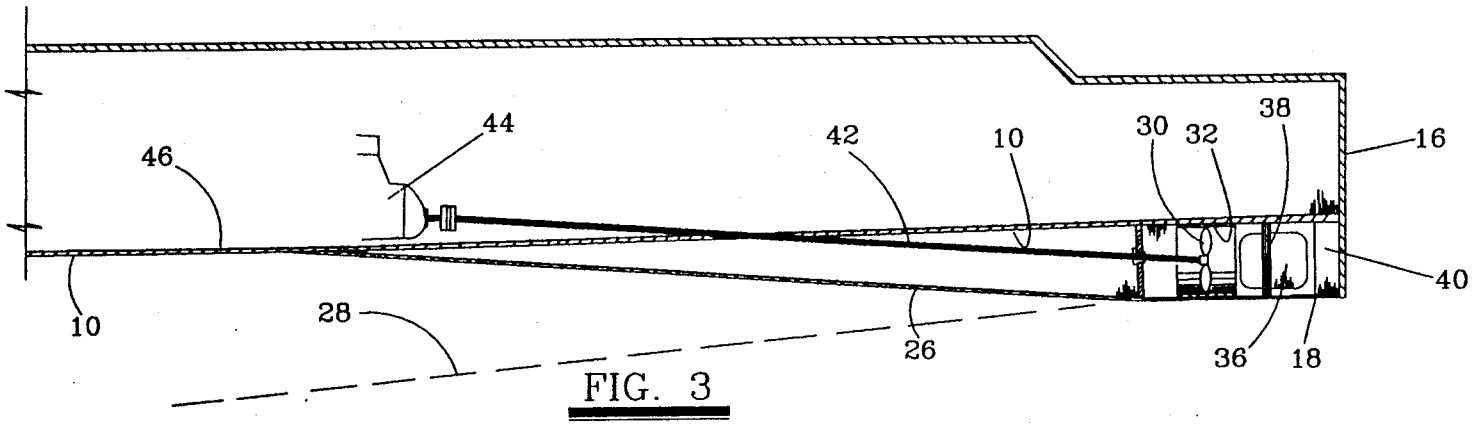
FIG. 3 is a cross-sectional view taken along the line 3—3 of FIG. 2.

FIGS. 1–16 illustrate a first embodiment of the invention incorporated in a high speed marine vessel having a shallow planing type hull. Referring to FIGS. 1–3, the hull includes a main undersurface 10. Extending upwardly from undersurface 10 are a bow portion 12, side walls 14 continuous with the bow portion 12, and a rear or transom wall 16 interconnecting the rearmost edges of the sidewalls 14. A generally horizontal bottom plate 18 is spaced downwardly from the rearmost portion of undersurface 10 and interconnected thereto by a plurality of generally vertically disposed side plates **20*a* and 20*b***.

Side plates **20*a* and 20*b* project forwardly beyond the foremost edge of the bottom plate 18, and the lower edges of the portions of the side plates 20*a* and 20*b* so projecting are inclined upwardly and forwardly so that they meet or intersect main undersurface 10**. Side plates 20*a* are disposed at the laterally outermost extremities of bottom 18 and adjacent side walls 14 of the hull. However, plates 20*a* and the corresponding laterally outer edges of bottom plate 18 terminate laterally inwardly of walls 14 to allow for the formation of downwardly facing steps 22 running longitudinally along the sides of the boat hull adjacent and just below walls 14, also adjacent and just above plates 20*a*.

Plates 20*a* differ from plates 20*b* in that their forwardly projecting portions project forward a much greater distance than those of plates 20*b*, and also in that they extend all the way to the rear extremity of bottom plate 18, whereas plates 20*b* stop short of the rear extremity of plate 18 as shown in FIG. 2.

The stern portion of the boat hull may be considered as comprising a plurality of longitudinally extending channels, each such channel, respectively, being disposed generally between two adjacent side plates 20*a* and/or 20*b*. The word "channel" is used herein in a very general sense. The word "channel" will refer generically to structures, such as tubes, which are fully laterally closed, as well as to structures which are open on at least one lateral side, as well to structures having sections which are fully laterally closed and other sections which are not fully laterally closed. In the context of the description of these channels, "lateral" will refer to the entire periphery which is seen in transverse cross section, in this case, to the top, bottom and both sides. Furthermore, as will be explained more fully below, it is believed that, in use, the boat hull and propulsion system according to the present invention sets up fluid flow paths in the water moving relative to the boat hull. These paths need not be fully structurally defined by portions of the boat hull, but may be at least partially self-defined by the moving water itself. Such a flow path may extend forwardly beyond the fore edges of side plates 20*b*, and the adjacent portions of the boat hull may be considered parts of the channels, for present purposes. Thus, a "channel," for purposes of this specification, may, at least along certain sections of its length, be structurally defined on only one side.

Each of the side plates 20*b* serves as a common side wall for two adjacent channels, one on either side of the plate 20*b*. Also, plate 18 may be considered as four continuous bottom walls, each for a respective one of the four channels. It can be seen that the four channels are open-ended, both upstream and downstream (see also FIG. 4).

Each of the channels has a core section which is fully laterally closed, its top being defined by the undersurface 10, its bottom being defined by the respective portion of bottom plate 18, and its sides being defined by the respective side plates 20*a* and/or 20*b*. For example, the core section of the channel shown at the lower right in FIG. 2 is designated by the numeral 24, and all of the other core sections, as well as the channels themselves, are laterally aligned across the boat hull.

A respective rib 26 depends downwardly from undersurface 10 and extends along the center of each channel, respectively, upstream of the core section. Although in other embodiments, the rib could have a spiral or twist to it, it is preferred that the rib be "true" along its length, as shown. The section of the channel along which rib 26 extends will be called the "transition section" herein. The structure and function of ribs 26 will be explained more fully below. For the time being, it is important to realize that, because of the unique definition of the term "channel" in this specification, one must bear in mind that the channels referred to are not defined between adjacent ribs 26, but rather between adjacent plates 20*a* and/or 20*b*, with a respective rib 26 generally bisecting the transition section of each channel.

From the known displacement of a given vessel, along with the empirically observed absence of a bow wave or wake, it can be concluded that a certain volume of water passes longitudinally through the channels in a given period of time. It can further be deduced that this volume of water could not pass through the restricted or fully closed core sections of the channels in the time in question if the water were only moving at the same relative speed as the boat moves with respect to the body of water as a whole. It is therefore reasoned that the water moving through the channels must be accelerated, and that this in turn occurs by virtue of pressure changes effected by the rotors, to be described below, and the speed of the vessel. Thus, it can be concluded that the action of the water moving through the channels corresponds generally to the reverse of the action of a fluid moving through a conventional venturi, or to a ram type engine in aircraft. The upstream end of the core section of each channel would correspond to the orifice of such a "reverse venturi," with the core section itself corresponding to the high pressure chamber. The transition section of the channel, upstream of the core section, would then correspond to the long, gradually tapered diffuser of the venturi, whose transverse cross section gradually increases over a relatively great length extending out away from the orifice.

Because the rib 26 extending along the center of each such transition section increases in depth from its upstream end to its downstream end, it consumes an increasing amount of the potentially available transverse cross-sectional flow area as it approaches the core section beginning at bottom plate 18 (see FIGS. 7–12). Thus, flow area available for water is gradually decreased, and in accord with the principles mentioned above, the water is accelerated along the transition area as it flows downstream. However, it is believed that the mass of water being so accelerated, which as explained above defines its own lower boundary, will also flow in such a manner as to further decrease that cross-sectional area, as indicated by the phantom line 28 in FIG. 3.

It is a goal of the present invention to provide channels which will ingest at least a large part of the water which would otherwise form a bow wave. Ideally, the entire displacement of the vessel should be ingested. A respective propeller or rotor 30 is mounted in each core section, spaced rearwardly from the fore end of the core section (which coincides with the fore end of plate 18), and spaced even further forwardly of the aft end of the core section (which coincides with aft end of plate 20*b*). The rotor is configured and mounted so as to cause fluid flow in a downstream direction with respect to the boat hull. The portion of the core section forward of the rotor may be considered a reservoir which is self-pressurized in use, and from which the rotor continuously evacuates water. This causes the aforementioned movement of water through the channel. The greater the volume or mass of water which can be so moved, the more completely the displacement of the vessel will be ingested, and also the greater the thrust which can be obtained. In other words, the vessel is propelled not simply by the propeller taking purchase against the water, but by virtue of the acceleration and pressurization of water which causes a large mass thereof to move through the channels.

Figure 4:
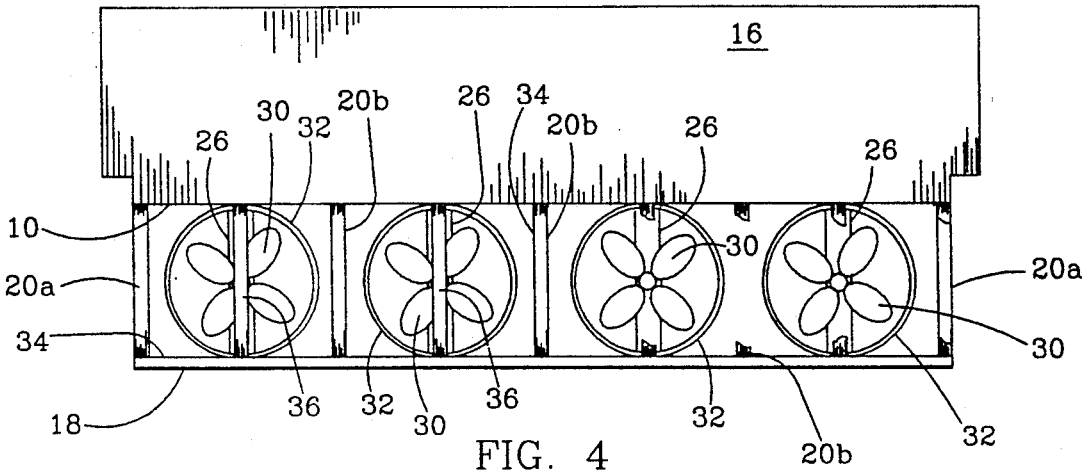
FIG. 4 is a rear elevation view taken along the line 4—4 of FIG. 2.

In order to enable the movement of an even greater mass or volume of water through each channel, a short cylindrical ring 32 is provided concentrically about each of the rotors 30. The ring is slightly longer longitudinally than the rotor, but is nevertheless short enough to be spaced slightly rearwardly from the fore end of the core section, and an even greater distance from the aft end of the core section. The core section is generally rectangular in transverse cross section, as shown in FIG. 4, and also by comparison of FIGS. 2 and 3, with the longer dimension extending laterally and the shorter dimension extending vertically. Ring 32 is generally tangent to, and affixed, as by welding, to the upper and lower inner walls of the core section, i.e. undersurface 10 and bottom plate 18, but is spaced from the side walls defined by plates 20*a* and/or 20*b* to define bypass areas 34 within each core section externally of its respective ring 32. Also, by virtue of the difference in configuration as between the cylindrical ring 32 and the rectangular interior walls of the core section, these bypass areas extend at least partially along the upper and lower surfaces of the ring 32. As shown in greater detail in FIG. 7, ring 32 may be further braced with respect to the walls of the core section by lateral struts 37.

Figure 12:
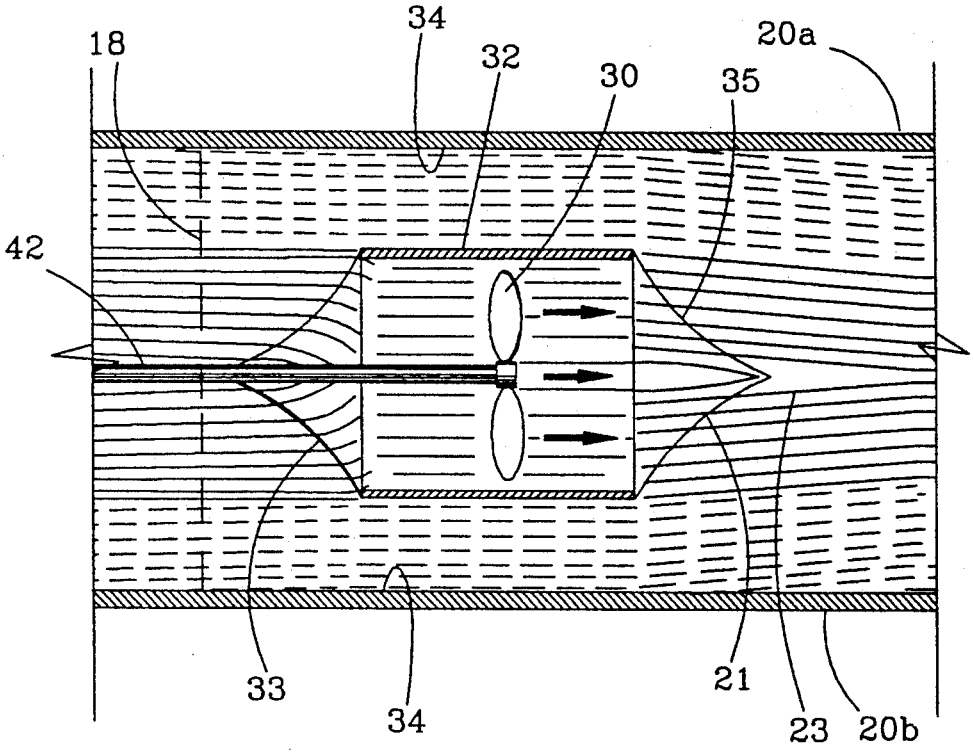
FIG. 12 is a longitudinal cross-sectional view, in a horizontal plane, through the center of one core section illustrating the fluid flow patterns set up by the rotor.

As best shown in FIG. 12, the rotor 30 directly moves a primary stream of water indicated in solid lines. The provision of the bypasses 34 allows this primary mass of water to entrain additional (secondary) water, indicated by dash lines, which is moved through the bypasses 34. Pressure differentials set up by the primary flow and the enclosure of rotor 30 in ring 32 also enhance secondary or "induced" flow. The secondary flow through bypasses 34 substantially increases the total mass of water moved through the channel, with the aforementioned advantages.

Ring 32 is preferably sized to leave about one inch clearance about the radially outer extremity of rotor 30. Rectangular core sections, as shown, are preferred, and it has been found that good results are obtained if the ratio of the total cross-sectional area within the core section to the cross-sectional area within the ring 32 is about 2.3 to 1.

Water upstream and downstream of ring 32, in a locus defined by lines 33 and 35, will rotate under influence of propeller 30. Also, low pressure areas will form immediately upstream and downstream of propeller 30 and in alignment with its axis. The downstream low pressure area is indicated at 21. Water emerging from the propeller area will tend to "fall into" the low pressure area 21, as indicated by the converging downstream solid lines at 23. Eventually, downstream of area 21, the water streamlines will begin to flare back out, i.e. diverge. If area 21 were too short, such diverging water could strike the walls of the core section. Parameters of the propeller, its speed, etc. can be adjusted by iteration, using known theories, to achieve a sufficiently long area 21 for a given core section.

The diameter of drive shaft 42 should be nearly as large as that of the hub of propeller 30 to avoid a substantial shoulder which could interfere with the desired flow pattern. Other details of the propeller will be described below.

Referring now especially to FIGS. 3 and 4, a respective trim tab 36 is mounted in the center of each channel aft of ring 32 on a vertical pivot shaft 38 extending between undersurface 10 and bottom plate 18. In general, the vessel can be steered by varying the speeds of the various rotors 30. However, if all of the engines are turning in the same direction, then even though two of the rotors 30 turn clockwise and the other two counterclockwise, the vessel will have a tendency to veer toward one side or the other due to engine torque. For this reason, as well as for any other fine adjustments which may be necessary, trim tabs 36 or other suitable means are provided to "fine tune" the steering. Means can be provided for operating the trim tabs from a control room on the vessel in a manner which will be readily apparent to those of skill in the art. Also, aft of each trim tab 36, and indeed at the extreme stern end of the vessel, a vertical strut 40 is provided in each of the channels interconnecting the undersurface 10 and the bottom plate 18.

As previously mentioned, each of the ribs 26 has a lower face which is inclined upwardly and forwardly from the bottom plate 18 to meet the undersurface 10. This serves several functions. As already mentioned, it serves to gradually decrease the transverse cross-sectional flow area of the channel in the downstream direction over the channel's transition section thereby helping to induce the reverse venturi or ram effect. Also, as shown in FIGS. 3 and 8–11, the rib 26 is hollow, and its increasing depth allows it to provide a convenient housing for a drive shaft 42 which allows an engine 44 in the primary interior usable space (exclusive of e.g. the interiors of the ribs) of the hull to be connected to a respective one of the rotors 30, which is disposed in a more or less exposed position outside the main undersurface 10, by a single, straight-line run of shaft 42. The rotor 30 may be mounted with its disk plane at a slight angle to true vertical to accommodate the angle of shaft 42, with the disk plane being perpendicular to the shaft. This does not affect the performance of the vessel.

The ribs 26 also serve to strengthen the hull in general, and are largely instrumental in eliminating the need for a conventional keel and conventional bulkheads and other internal supports, which in turn reduces weight. Finally, the inclination of the lower faces of the ribs allows a shallow draft vessel of 10 the type depicted in FIGS. 1 et. seq. to be beached, the ribs defining a slanted support surface for that purpose, and also cooperating with the bottom plate 18 to protect the rotors 30. Then, at low tide, the rotors 30 and/or other parts can be serviced, and the vessel withdrawn at the next high tide. Ribs 26 and bottom plate 18 in a sense provide self-contained mounting blocks for the vessel while such work is being done.

As shown in FIGS. 2 and 8–11, the lateral width of the rib 26 decreases in the downstream direction. However, this decrease is more than offset by the increase in the depth of the rib 26, as well as by the self-defined lower extremity 28 of the channel, so that the overall change in transverse cross-sectional flow area in the downstream direction is a decrease, rather than an increase.

As best shown in FIG. 3, the bottom of the hull which defines the undersurface 10 is inclined slightly upwardly and rearwardly over the transition section of the channel. This allows for adequate propeller diameter without undue increase in the draft of the vessel by placing at least a part of the rotor above the lowest measured depth of the primary usable interior space of the hull, i.e. above a point 46 just forward of the transition sections of the channels. It might be thought that this would effect a downstream or rearward increase in transverse cross-sectional flow area, but that effect is illusory; the lower boundary 28 will adjust itself, with the assistance of the increasing depth of the rib 26, to provide the appropriate decrease in flow area as previously explained.

Figure 5:
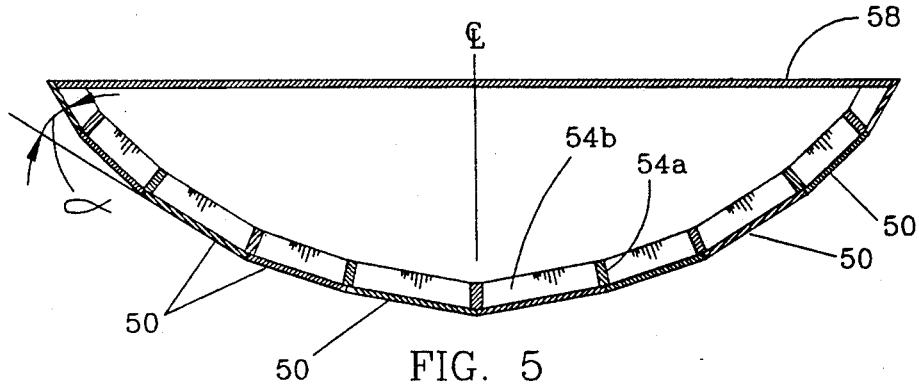
FIG. 5 is a transverse cross-sectional view taken along the line 5—5 of FIG. 2.
Figure 13:
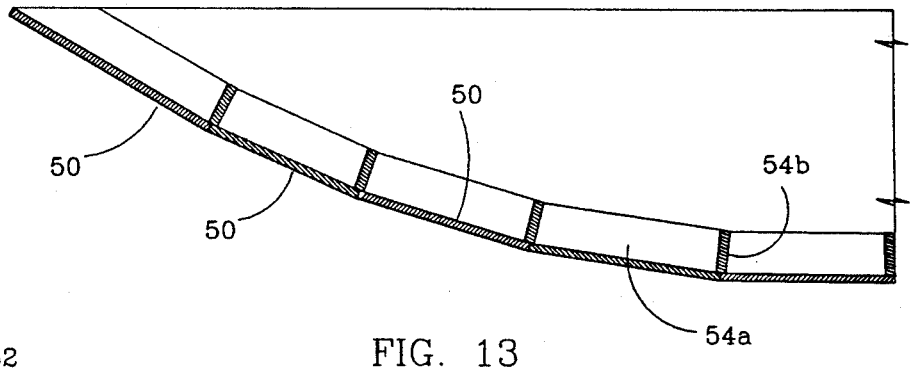
FIG. 13 is a detailed cross-sectional view through the bow portion.

The bow portion 12 of the hull is not smoothly curved, as is conventional, but is formed of a number of substantially flat plates 50 angularly joined together, as by welding, to approximate a more conventional streamlined bow curve converging along the center 52. These plates are more numerous, but smaller, than those indicated in prior U.S. Pat. No. 4,505,684, and improve in several respects. The vast majority of the plates 50 are four sided. As shown in FIG. 5, they are angularly disposed with respect to one another in transverse planes, and as shown in FIG. 13, they are also angularly disposed with respect to each other in longitudinal planes.

The sizes and angles of the plates are carefully chosen in accord with several criteria, and, the precise shapes, not all of which are true rectangles, are extrapolated to give the desired bow configuration.

Figure 16:
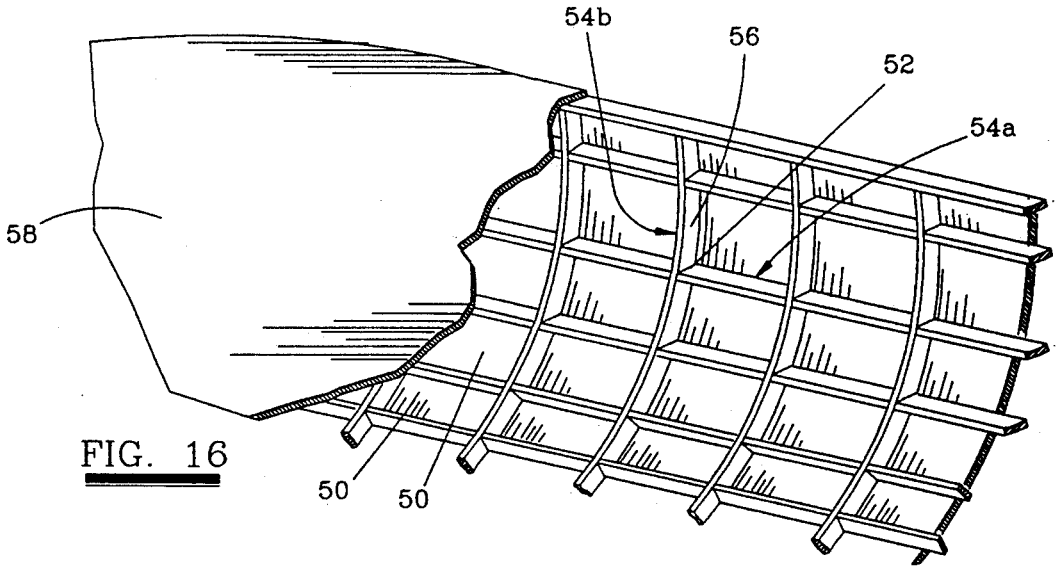
FIG. 16 is a detailed perspective view of the interior of the hull.

Before reverting to a description of the criteria for sizing and orienting plates 50, it is important to note that the interior of the boat hull is braced by a construction method, well known in the engineering arts in general, but not conventionally applied to marine vessels. That method is "intercostal" construction. The intercostal construction is illustrated in FIGS. 5, 6, 13 and 16 and can be understood by way of contrast to a more conventional construction method. Specifically, in a more conventional method, which is common, for example, in office building construction, one I-beam may be positioned on top of another, but at an angle thereto, so that the height of the joint therebetween is the sum of the heights of the two beams. In intercostal construction, as illustrated in FIG. 16, the end edge 52 of a plate-like brace member or stringer 54*a* running in one direction, in this case longitudinal, is butted against one of the broad surfaces 56 of another member 54*b* running in a transverse direction. Thus, the total height or thickness of the joint is simply the width of the wider of the two members, if they differ.

In accord with the present invention, it is possible to use this intercostal construction method not only in place of more conventional beams, girders and joints, but also in place of conventional bulkheads and a conventional keel. This not only substantially reduces weight, but also maximizes the primary interior usable space of the hull. It will be understood that decking 58 will ordinarily be emplaced across the upper edges of the hull, and that any suitable cabin or other superstructure desired could be included in the vessel.

Reverting now to the criteria for sizing and positioning the bow plates 50, it is first noted that in the bow portion 12 of the hull, the intercostal bracing members or stringers 54*a* and 54*b* will be positioned to coincide with the edges of the bow plates 50, so that the edges of the bow plates and the members 54*a* and 54*b* form corresponding matrix-like structures. Each plate 50 can vibrate, like the head of a drum, because of the frequencies which are generated in use of the boat. Each piece of working machinery on or in the boat contributes its particular frequencies to the excitation of the plates 50, so that the overall exciting function is the product of these frequencies. Also, many higher frequencies, or harmonics, of the fundamental plate frequency are also generated. For example, with an internal combustion engine with a speed of 2300 rpm, a two-stage reduction transmission, a four blade propeller, and four engine-reducer-propeller units, the product gives an exciting frequency of 73,600 Hertz, plus the aforementioned harmonics. This excitation can cause failure of the welds between plates if the plates are not appropriately sized.

While the criteria for such sizing can be determined by known engineering calculations, a few helpful general principles are presented here. First, the necessary thickness of the plates can be drastically reduced if the material of which the plates are formed is high strength steel. There may be reluctance to use steel because of its relatively high density. However, the strength of high strength steel, as opposed to other forms of steel, can so greatly reduce the necessary thickness of the plates, that the overall weight will be less than if the hull were formed of a "lighter" substance, such as fiberglass, aluminum, wood, or the like. Secondly, the higher the exciting frequencies anticipated, the shorter should be the long dimensions (i.e. length and width, as opposed to thickness) of the plates. This is not to say that other materials may not be used in some embodiments. In general, the sizes of bow plates 50 can decrease rearwardly, i.e. a plate is generally smaller than one ahead of it.

Figure 14:
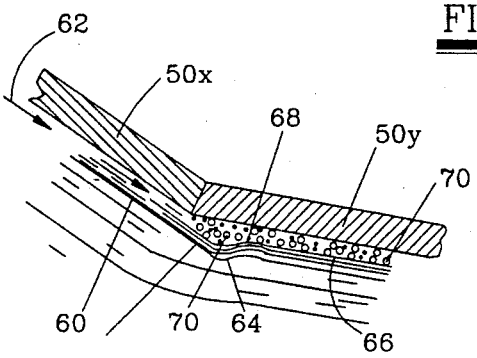
FIG. 14 is an enlarged detailed view illustrating Coanda flow characteristics and gas lubrication.

Another of the criteria used to size and position the plates 50 is the goal of inducing gas lubrication over the bow section of the hull. This may be done by taking advantage of a phenomenon known in the physical sciences as the "Coanda" effect. Briefly, and in practical terms, the Coanda effect pertains to tendencies in the characteristics of a fluid flowing relative to a solid surface. A thin layer or streamline of the fluid will tend to cling to and follow the surface as the surface curves, so long as the curve or equivalent angle is not too sharp. FIG. 14 illustrates the phenomenon as applied to a bend formed by the angle between two bow plates 50*x* and 50*y*, rather than by a smooth curve (although the same action might be observed with certain types of curves). The streamlines of a thin, film-like layer of water 60 following the upstream plate 50*x* cannot bend as sharply as the plates themselves at their joint; its momentum will tend to carry it forward a short distance in the same direction as the arrows 62 which represent its initial movement. Thus, it will separate somewhat from the surface just downstream of the joint as indicated at 64. However, due to the Coanda effect, the stream will turn back toward the surface of the next plate 50*y* and follow it as indicated at 66. The increased separation at 64 creates a low pressure zone 68 near the joint between the two plates 50*x* and 50*y*. Due to the very low pressure in this zone 68, gases entrained and/or dissolved in the water separate in that zone, as depicted by the bubbles 70. These bubbles are swept along with, but contained within, the continuation 66 of the streamline. It will be appreciated that this is repeated at each joint. Furthermore, because the plates 50 are angled in both longitudinal and transverse directions, there will be spanwise flow, which increases the separation areas 68, and further enhances the gas lubrication effect. In general, the higher the intended speed of the vessel, the lesser the angle necessary to provide adequate gas lubrication. In general, it is advantageous for the acute angle $\alpha$ (FIG. 5) between at least the great majority of the plates to be less than or equal to 30°.

This lubricating gas 70 greatly reduces the resistance to forward movement of the bow 12 of the boat, both in terms of friction, and also in terms of drag. This reduction in resistance has numerous salient effects. It allows either a decrease in energy required to move the boat, and/or an increase in thrust and/or speed. This in turn helps to compensate for the weight which is added to the hull by the presence of the ribs 26, bottom plate 18, and side plates 20*a* and 20*b*. The long outer side plates 20*a* help to retain the lubricating gas along the aft portion of the hull, and it is believed that, with adequate gas generation, and proper sizing of the plates 20*a*, virtually the entire hull can be gas lubricated.

Figure 15:
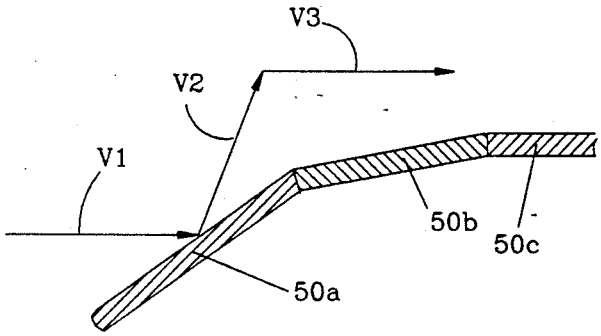
FIG. 15 is an enlarged detailed view showing minimization of secondary water impingement.

Still another criterion for the sizing and disposition of the bow plates 50 is illustrated in FIG. 15. Since it is desired that the bow of the vessel provide a certain amount of lift, particularly in a planing type hull of the type illustrated, some impingement of water on the relatively moving bow is necessary. However, it is believed desirable, within reasonable limits, and in accord with the other criteria for the design of the bow plates, to minimize what will be referred to herein as "secondary impingement." Assume a given particle of water first strikes the foremost plate 50*a* in FIG. 15 as indicated by the vector $V_1$. This particle will rebound as indicated by the vector $V_2$, equal in size but opposite in angle. Simultaneously, the boat will move forward relative to the water particle, so that the water particle moves relative to the boat, by a distance, and in a direction, as indicated by the vector $V_3$, so that the point of vector $V_3$ represents the final position of the water particle from the combined effects of its impact with the first plate and the forward movement of the boat. As can be seen, the plates are sized and angled so that the water particle will miss the next plate 50*b*, and preferably also even the next one 50*c*. This is what is meant by minimization of secondary impingement, minimization of the extent to which a particle rebounding from one plate will strike subsequent plates. Like gas lubrication, such minimization contributes to the reduction of the resistance of the water to the forward movement of the vessel.

Still another criterion is that, as previously mentioned, the bow of the vessel should provide lift, particularly in a planing craft. The hull is relatively shallow and flat, and is intended to rise up on the water and ride high on the surface of the water, with relatively little displacement when it is up to full speed. As a practical matter, the plates 50 will always provide some lift if they are inclined upwardly and forwardly, which is necessary to provide the approximation of a normal convergent bow configuration. Also, the plates 50 will be angularly disposed for purposes of inducing gas lubrication and minimizing secondary impingement, so that they will, again, automatically provide some lift. However, within the limits of adequate gas lubrication and not excessive secondary impingement, the angles of the plates may be further adjusted to provide a desired amount of lift.

It will be appreciated that the various criteria given above might be, to some extent, inconsistent with each other. In any event, they need to be coordinated so as to strike a balance between the achievement of the various goals, and to optimize certain of the goals more or less depending on the precise intended use of the vessel. This can be done by an iterative calculation process known in the engineering and architectural arts as "the inward design spiral." Briefly, beginning with one of the criteria, a starting point design is laid out. Then, suitable calculations are performed to see how this design will affect the other criteria. Adjustments may be made in the angles and/or sizes of the plates in accord with these other criteria, one by one, until one arrives back at the beginning of the spiral, to see how the adjustments will affect the initial criterion. By continued iteration, a suitable design for a given vessel is achievable.

It will be appreciated by those of skill in the art that the resistance to forward movement should be calculated to derive lift. However, these calculations should differ somewhat from the conventional approach because of the unique action of the vessel due to the channels. Rather than trying to ride up the bow wave like a conventional planing craft, this vessel ingests the water that would have formed the bow wave through the channels. This tends to draw water away from the walls, lessening the frictional resistance of the wetted surface, which is further reduced by the aforementioned gas lubrication. Air resistance is so low in this shallow profile planing craft that it can be ignored.

It is useful to calculate the resistance of each of four strips running lengthwise along the hull, and which cumulatively span its breadth. Each strip includes one channel, the respective aligned forward portion, and in the case of the laterally outer channels, the shoulders 22.

Conventionally, resistance, $R_f$, is given by the equation:

*a*) $R_f = fSV^{1.83}$ where f = coefficient of friction

S = wetted surface area (in ft.$^2$)

V = speed (in Knots).

Due to the resistance-reducing effects of the present invention, a more appropriate equation for calculating the resistance of one of the aforementioned strips is:

$R_f = 0.025S'V$ where

S' = wetted surface area of one strip (in ft$^2$)

V = speed (in ft./sec.).

This results in a resistance in pounds. The resistances for the four strips are calculated, then added, to give total resistance. Equation (b) will give acceptable results, much more accurate as to the present invention than conventional equation (a). However, equation (b) may be further refined based on empirical data, especially if different embodiments of the invention are developed.

The stern portion of the vessel is designed to provide an amount of lift which will generally balance that imparted to the bow by the inclination of the bow plates. This can be done by slightly inclining various downwardly facing surfaces near the stern of the vessel. In sufficiently long vessels, such as those illustrated in the drawings hereto, adequate lift can be obtained from the undersides of ribs 26, and their precise angles are chosen accordingly. In shorter vessels, it may be desirable also to use the bottom plate 18 for this purpose. Bottom plate 18 has such a large surface area that it can provide substantial lift by only slight inclination, e.g. 1° or 2°. However, in the embodiments shown herein, the bottom plates are straight horizontal. With the lift thus balanced, as the vessel increases in speed upon start up, it will tend to rise up on the water with a translational type movement, rather than by having the bow canted up. This substantially enhances the comfort of the personnel on board and their ability to move about the vessel and perform normal activities, even though traveling at a very high rate of speed.

It might be thought that, with the lift areas at the bow gradually emerging from the water as the vessel rises up and planes, but with the plate 18 and the lower faces of ribs 26 always submerged and continuing to provide lift, the vessel might tend to cant nose down. This does not occur, however, because the relatively large mass of water contained above plate 18 provides sufficient inertia to resist such canting. This effect can be enhanced by extending plate 18 somewhat rearwardly beyond the length necessary to provide adequate core sections for the channels. The downwardly facing shoulders 22 also help to generally stabilize the vessel in the water.

Figure 6:
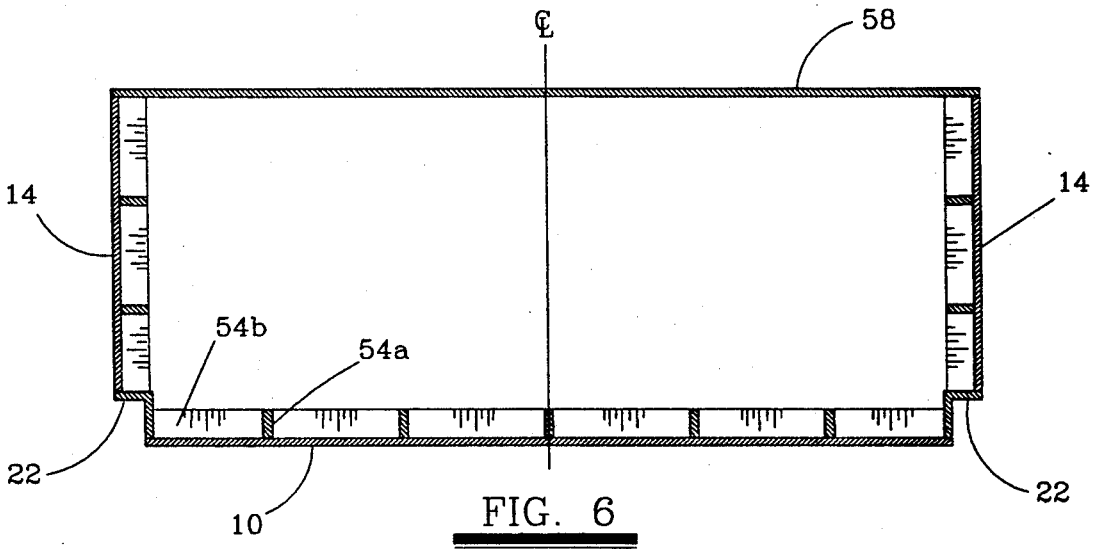
FIG. 6 is a transverse cross-sectional view taken along the line 6—6 of FIG. 2.
Figure 7:
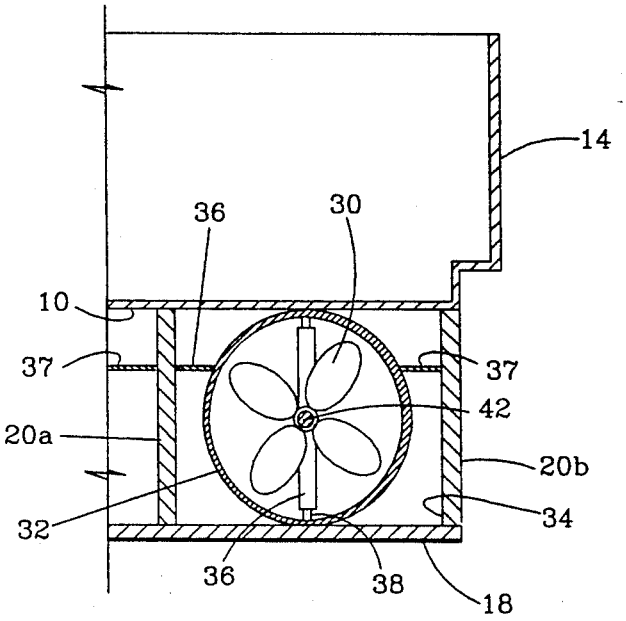
FIG. 7 is a cross-sectional view taken along the line 7—7 of FIG. 2.
Figure 8:
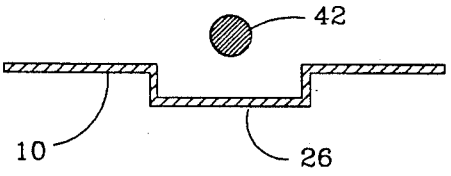
FIGS. 8–11 are a series of detailed transverse cross-sectional views at different points along the length of the rib 26.
Figure 9:
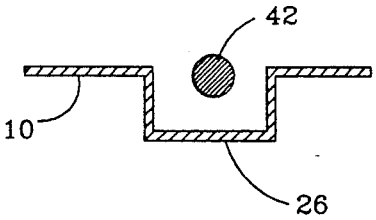
Figure 10:
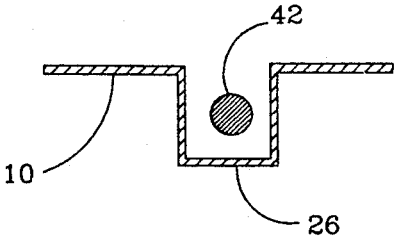
Figure 11:
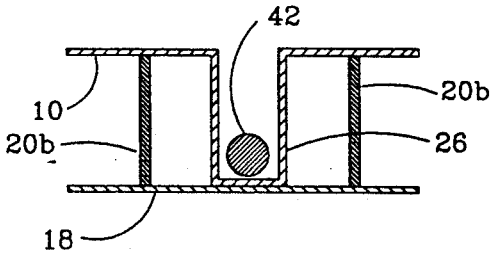

Overall stability, and more specifically, resistance to pitch and roll, are afforded not only by the mass of water contained above bottom plate 18, but also by the generally flattened configuration of the underside of the hull as a whole. With the exception of the bow portion 12, the undersurface 10 is straight horizontal in the transverse direction, as seen in FIG. 6, and except for the slight upward inclination thereof through the transition sections of the channels, is also straight horizontal in the longitudinal direction. Likewise, the large bottom plate 18 is substantially horizontal, with only a slight inclination. The plates 20*a* and 20*b* help to keep the vessel true in the water, as well as resisting yaw, and may be assisted in this regard by the ribs 26.

The iterative calculation process making up the inward design spiral by which the bow plates 50 are sized and disposed is expanded in making the calculations for the overall design of the hull and propulsion system, since the parameters of various parts will affect the performance of others. With an optimized design, it is believed that the present invention will permit a vessel to achieve substantially higher speeds and better acceleration for a given horsepower. While conventional thinking might imply that the added weight from the walls 20*a* and 20*b*, bottom plate 18, ribs 26, rings 32, etc. would make the vessel slow and cumbersome, so effective is the enhanced propulsion achieved by the channels and rotors, and further enhanced by the bow design, that the speed and other performance of the vessel is quite surprising.

Figure 17:
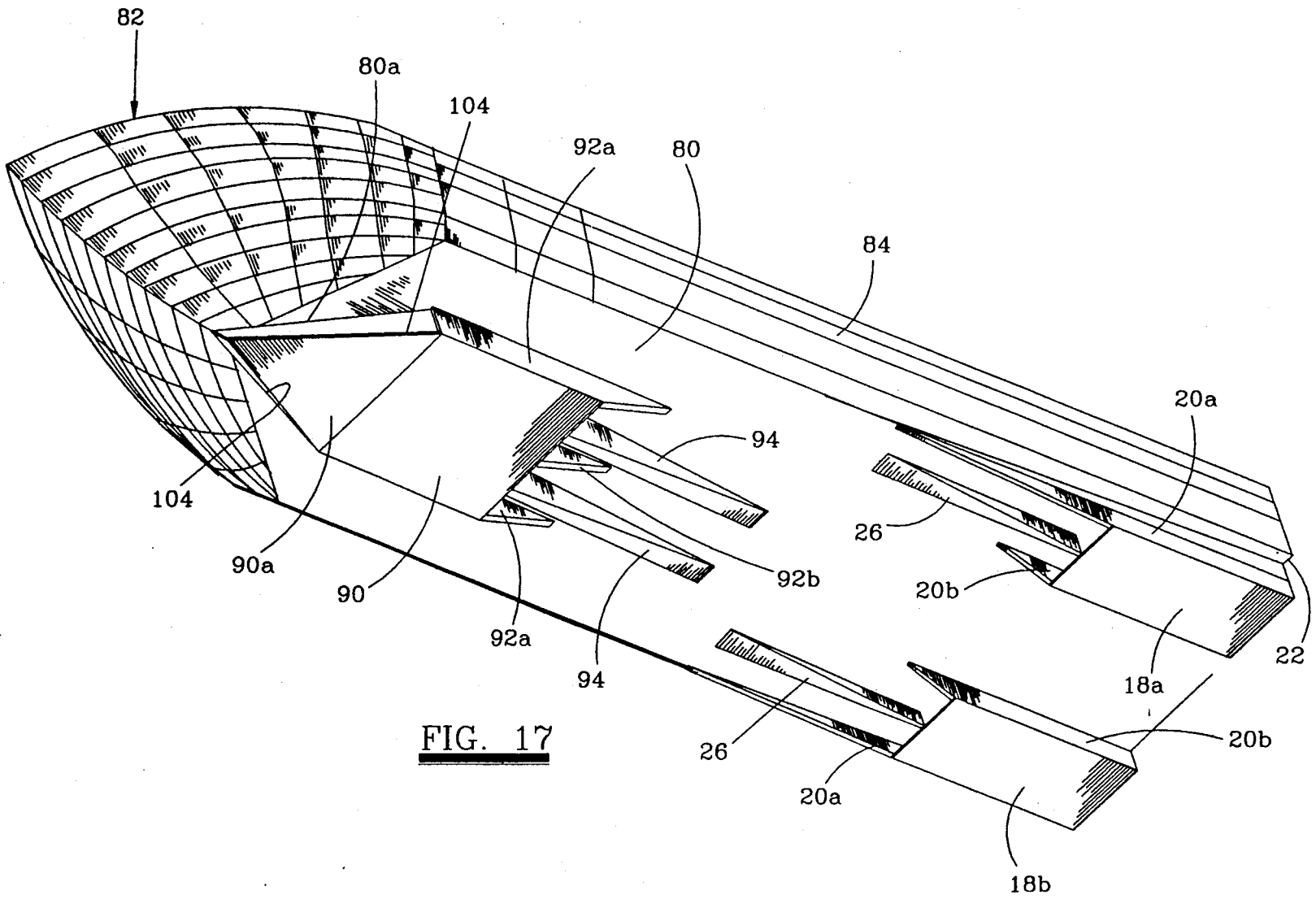
FIG. 17 is a perspective view of a second embodiment of the invention.
Figure 18:
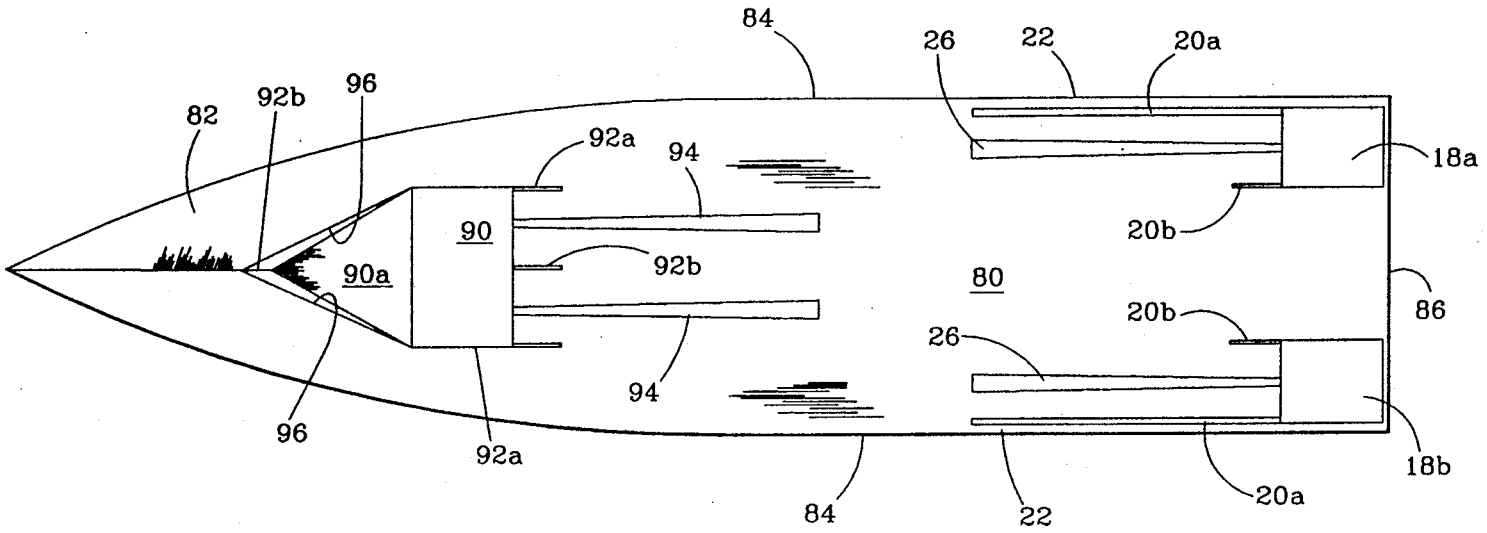
FIG. 18 is a bottom plan view of the embodiment of FIG. 17.
Figure 19:
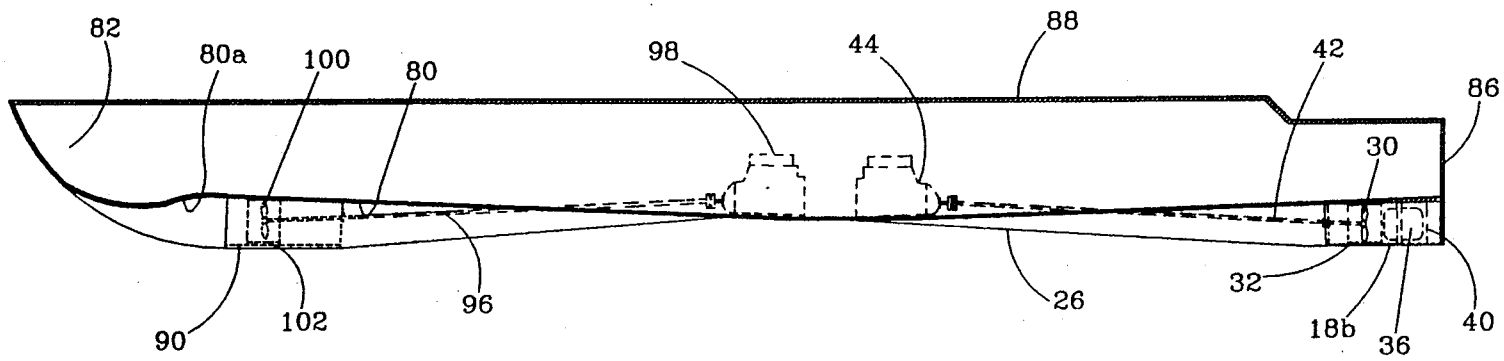
FIG. 19 is a longitudinal cross-sectional view of the embodiment of FIG. 17.

Turning now to FIGS. 17–19, there is shown a second embodiment of the invention. Whereas the first embodiment was a shallow planing type craft designed for high speed operations, the second embodiment is a larger displacement type vessel which, while capable of operating at much higher speeds than a similar conventional craft, is designed to emphasize load carrying capacity somewhat more so than speed, by way of comparison to the first embodiment. For example, the first embodiment might be most applicable for use as a Coast Guard cutter, whereas the second embodiment might be useful in transporting cargo and/or people, but at relatively high speeds as such vessels go.

The hull of the embodiment of FIGS. 17–19 is longer and deeper in draft than the preceding embodiment. It includes main undersurface 80, bow portion 82, side walls 84, transom wall 86, and decking 88. Any suitable superstructure desired may be provided.

At the laterally outer sides of the stern of the vessel, there are two channels which, except for size, are virtually identical to the outermost channels of the first embodiment. Specifically, these channels include fully laterally closed core sections defined by undersurface 80, respective bottom plates 18*a* and 18*b*, and side plates 20*a* and 20*b*. Plates 18*a* and 18*b* are separate, rather than continuous, since there are no more channels disposed immediately between the two stern channels. Otherwise, the shapes and relative sizes and dispositions of these various plates are virtually the same as the corresponding parts of the first embodiment. In particular, plates 20*a* project forwardly farther than plates 20*b*, and their inclined lower edges generally parallel the lower faces of downwardly depending ribs 26 which house propeller shafts extending from engines 44 to propellers 30 rotatably mounted in the core sections. Propellers 30 are likewise enclosed within rings 32, also similar to the like-numbered parts of the first embodiment. Trim tabs 36 and struts 40, similar to the like-numbered parts of the first embodiment, are also provided. Along the transition sections of these stern channels, i.e. generally along ribs 26, the undersurface 80 is inclined upwardly and rearwardly, as in the first embodiment. The stern channels are spaced slightly laterally inwardly from side walls 84 to provide steps 22. Because of the virtual identity of the stern channels with those of the first embodiment, their structure and function will not be further described in detail.

The embodiment of FIGS. 17–19 also includes two more channels which are disposed laterally between, but spaced forwardly of, the two stern channels. Thus, jointly, the four channels span the major part of the breadth of the vessel.

In many ways, except for their lateral displacement, the forward channels are mirror images of the stern channels across a transverse vertical plane. Thus, briefly, each of them includes a fully laterally enclosed core section defined between undersurface 80, a bottom plate 90 spaced below undersurface 80, and side plates 92*a* and 92*b* interconnecting the undersurface 80 and the bottom plate 90. Ribs 94, depending downwardly from undersurface 80, extend along the centers of the channels from the aft edges of bottom plate 90 rearwardly, with their lower faces inclined rearwardly and upwardly to meet undersurface 80. Ribs 94 are sized and shaped identically to ribs 26, except for being mirror images, and likewise house drive shafts 96 extending from engines 98 within the hull to propellers 100 mounted in the core sections. Propellers 100 are further encased within cylindrical rings 102, similar to rings 32. Due to these similarities, it is convenient to further describe the forward channels in terms of their differences from exact mirror images of the stern channels.

A single continuous bottom plate 90 provides the bottom plates for both of the forward channels. Because the forward channels are contiguous, they have a common side plate 92*b* therebetween. Bottom plate 90 has a main rectangular portion, disposed rearmost, and a triangular forward projection 90*a* which is inclined upwardly from its stern end to its forward apex, but no so much as to meet the undersurface 80, or more specifically, the bow portion 82 with which it is aligned.

The portion of undersurface 80 defining the tops of the forward channels may also be considered to have a triangular forward extension 80*a* aligned with extension 90*a* and extending into the bow portion 82.

The central side plate 92*b* is likewise extended forwardly and correspondingly shaped so that it interconnects the triangular front extension 90*a* of the bottom plate with the undersurface portion 80*a*. Thus, fully closed, but laterally and rearwardly angled inlets 104 are defined for the two forward channels, respectively.

The outermost side plates 92*a* extend along the entire length of the rectangular portion of bottom plate 90, and have inclined portions extending rearwardly there-from analogous to the forwardly extending portions of plates 20*a*. However, these extending portions of plates 92*a* are not longer than that of plate 92*b*; there is no need for this since they are not located near the laterally outer periphery of the undersurface and are therefore not being used to retain lubricating gas or restrict lateral flow of water from outside the hull.

The positioning of the ring 102 and enclosed propeller 100 also differs from a true mirror image with respect to the stern channels. If they were a true mirror image, they would be positioned closer to the aft end of the core section than the fore end. However, for operational reasons similar to those for the stern channels, it is desirable that these propellers be positioned closer to the fore ends of the core sections. The dispositions of ribs 94 and shafts 96 may be slightly adjusted accordingly.

It can be seen that the portions of the forward channels upstream of their core sections do not provide such long transition sections gradually decreasing in transverse cross section so as to facilitate reverse venturi action or ram action, as do the stern channels. However, because of the deeper displacement type form of the hull of the embodiment of FIGS. 17–19, the depth at which these core sections are disposed, coupled with the speed of the vessel, is adequate to cause self-pressurizing of the core sections just upstream of the propellers 100. All the core sections preceding all propellers of both embodiments described thus far have some means for self-pressurization, and this virtually eliminates propeller cavitation problems.

While the ribs 94 and inclined rearwardly projecting portions of plates 92*a* and 92*b* are generally mirror images of the corresponding parts of the stern channels, they do not provide the same fluidic action, since they are disposed at the outlet end, rather than the inlet end, of their respective channels. Nevertheless, they do provide other advantages analogous to those of the stern channels, such as conveniently providing for interconnection of the engines and rotors, strengthening of the hull without the need for a conventional keel, and helping to keep the vessel running true in the water.

Figure 20:
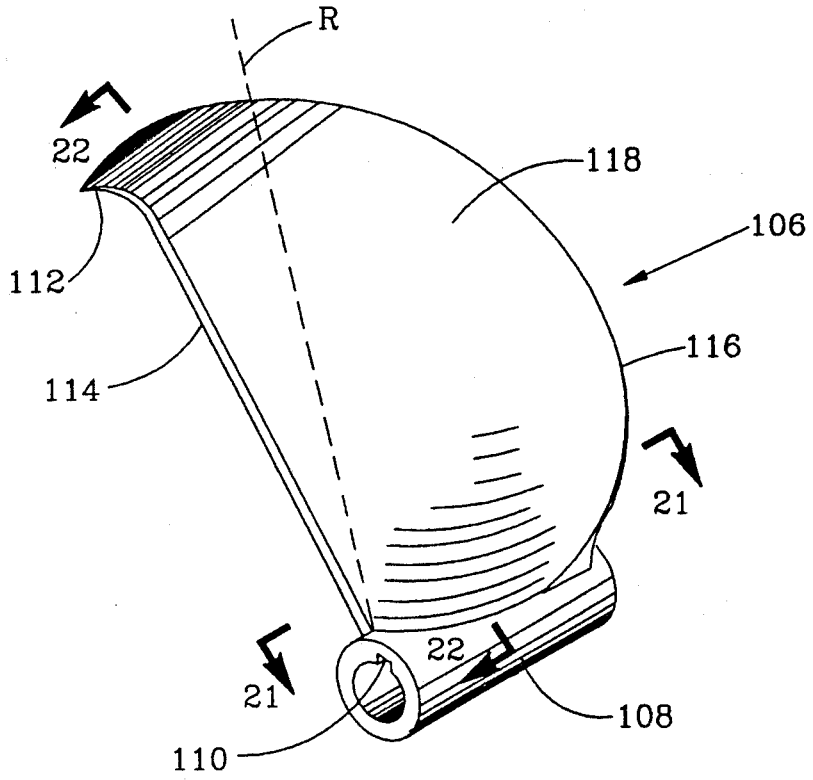
FIG. 20 is a perspective view of a rotor showing one blade.

The rotors 30 and 100 of the preferred embodiments are designed in a particular manner which works especially well in the context of the present invention. This will be described in connection with FIGS. 20 et. seq. In those figures, the rotor 30 is shown, but it will be understood that the rotor 100 is designed in accord with similar principles. Referring, then, to FIG. 20, it will first be noted that the rotor or propeller 30 has four blades or lobes, one of which is shown at 106 and the others of which are broken away. The blades emanate from a cylindrical hub 108 which is secured for joint rotation with the drive shaft in any manner well known in the art, e.g. by a key projecting into keyway 110. It has been found that, for purposes of the illustrated embodiments, a four blade rotor will ordinarily work better than a two or three blade rotor.

Due to the containment of water in the core sections and the pressurization of their reservoirs just ahead of their rotors, the design principles involved in tailoring a rotor for purposes of the present invention are more closely akin to those used in designing pump impellers, at least in some respects, than to those normally used in designing propellers for marine vessels. In conventional ship propellers, slip is the difference between the distance the propeller or "screw" would advance in one revolution if working in a solid medium and the distance it actually advances in position at the stern of the ship. Because of the pressurization and confinement of the water upstream of the rotor in the present invention, there is no slip. While conventional propellers operate in the wake of a ship, the presence or absence of wake has no effect on the rotors in the present invention. Also, and again due to the pressurization and confinement of water upstream thereof, the rotor in the present invention is not ordinarily subject to cavitation.

Although, as mentioned, cavitation is not ordinarily a problem due to the pressurization of the reservoir of the core section, there could be a problem with water thrown outward by centrifugal force eroding the rings 32 and 102 which surround the rotors in use. To prevent this, the radially outer edge of each blade is deflected rearwardly as shown at 112, i.e., in a downstream axial direction, to direct the water exiting the rotor more nearly downstream and away from the ring.

Like other aspects of the design of a vessel according to the present invention, design of the rotor involves a certain amount of iteration. However, the following can be assumed at the outset, as to preferred rotors according to the invention: One edge of the blade will be rectilinear, while the other edge will be curvilinear. In both of the embodiments described herein, it is the leading edge 114 that is rectilinear and the trailing edge 116 that is curvilinear. However, there may be other embodiments in which it would be desirable to reverse that arrangement.

The leading edge 114 is also raked forwardly from base to tip, as shown by comparison to the true radius R. Depending on the rotational speed of the rotor and/or the vessel application, there may be embodiments in which the leading edge of the blade would be raked rearwardly. In either case, the rake angle permits the use of a larger blade area than would otherwise be possible.

The "upstream" face 118 of the blade, which faces forward with reference to the vessel (actually the "back" face in conventional propeller terminology) is convex outwardly (see FIG. 21), while the other face 120 is flat.

The development of precise blade size, shape and pitch involves iteration based upon the following principles. As a broad general goal, the rotor should be designed to absorb the maximum power output of the engine, so that it cannot be damaged thereby. For new, modern engines, it is ordinarily safe to assume that the indicated horsepower (in the cylinder) is equal to the brake horsepower (at the output end of the shaft). Making this assumption, the brake horsepower for one cylinder, $P_b'$, is given by the equation:

*c*)

$$P_b' = p_m LAn/550$$

where:

$p_m$ = mean effective pressure within the engine (in psi.)

L = length of piston stroke (in ft.)

A = effective piston area (in in.$^2$)

n = number of power strokes per second.

Then, the total brake horsepower, $P_b$ is obtained by multiplying $P_b'$ by the number of cylinders.

Next, we consider the facts that the engine, in its power strokes, sweeps out a certain volume of gases per second, whereas each channel of the hull also has a volumetric through-put per second. These can be determined through well known methods, assuming operation at maximum speed. Accounting for the transmission ratio, the mean effective pressure in the engine, $p_m$ times the aforementioned engine through-put per second is equated to the thrust pressure on the rotor blades times the channel through-put per second. Solving for the thrust pressure on the propeller blades, we get the axial component of pressure on the blades, $p_a$.

The horsepower absorbed by the propeller imparts a torque to the propeller hub and blades, which in turn causes the blades to rotate and, due to their pitch, cause relative axial movement between the apparatus and the water. We can assume shaft horsepower, $P_s$, is initially equal to $P_b$. We know that

*d*)

$$P_s = P_b = Tn(0.00019)$$

where:

T = torque (in lb. ft.)

n = propeller rotational speed (in rpm)

$$0.00019 = \text{a conversion factor} = (2\pi \text{rad/rev.})\,(H_p \text{ min}/33000 \text{ lb. ft.}).$$

We can then solve for T:

*e*) $T = P_b/0.00019n$.

With the above values plus the starting configurational requirements (e.g. straight leading edge), we can develop the precise blade shape, size and pitch using conventional techniques such as those described in *Principles of Naval Architecture*, edited by John P. Comstock, The Society of Naval Architects and Marine Engineers, 1967.

Figure 21:
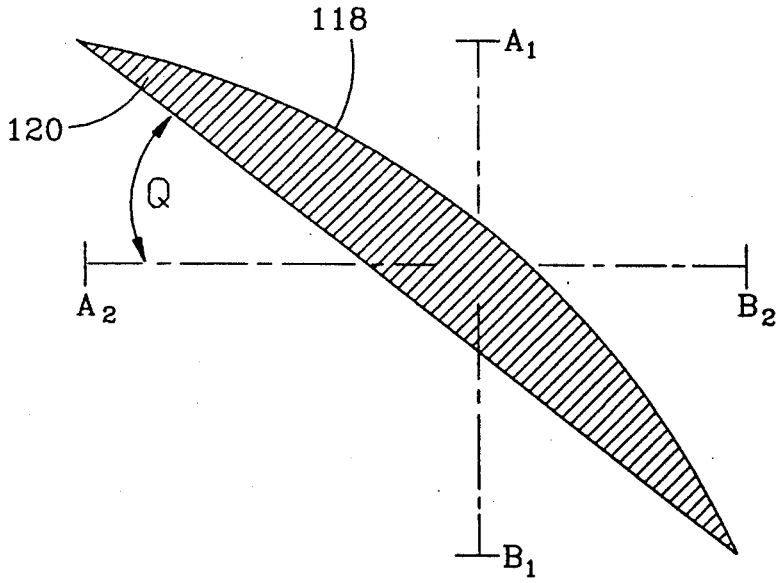
FIG. 21 is a transverse cross-sectional view taken on the line 21—21 of FIG. 20.
Figure 22:
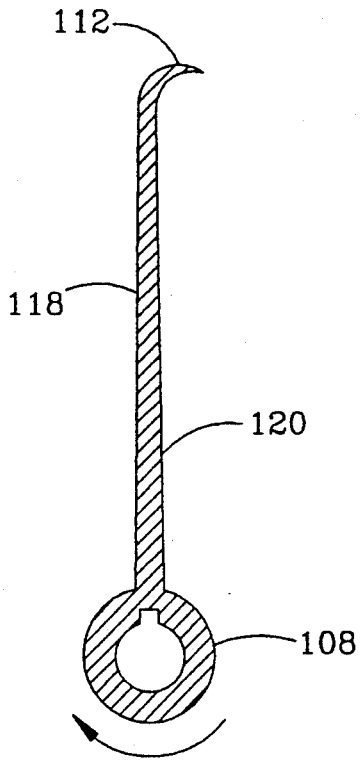
FIG. 22 is a lengthwise cross-sectional view taken on the line 22—22 of FIG. 20.

Briefly summarizing the application of these conventional techniques, the expanded or true blade area, seen in cross section in FIG. 21, can be visualized as two projections, in respective perpendicular planes, which jointly define the blade true area. The axial projection is parallel to the axis of the rotor and thus perpendicular to the disk plane. The portion of the axial projection corresponding to the blade section shown in FIG. 21 appears as the line $A_1B_1$. The area of the complete axial projection transfers the engine torque to the water.

The disk projection is in the disk plane, or a plane parallel thereto, and thus perpendicular to the axis. The portion of the disk projection corresponding to the blade section shown in FIG. 21 appears as the line $A_2B_2$. The area of the complete disk projection provides the thrust area for relative axial movement between the vessel and the water.

Figure 23:
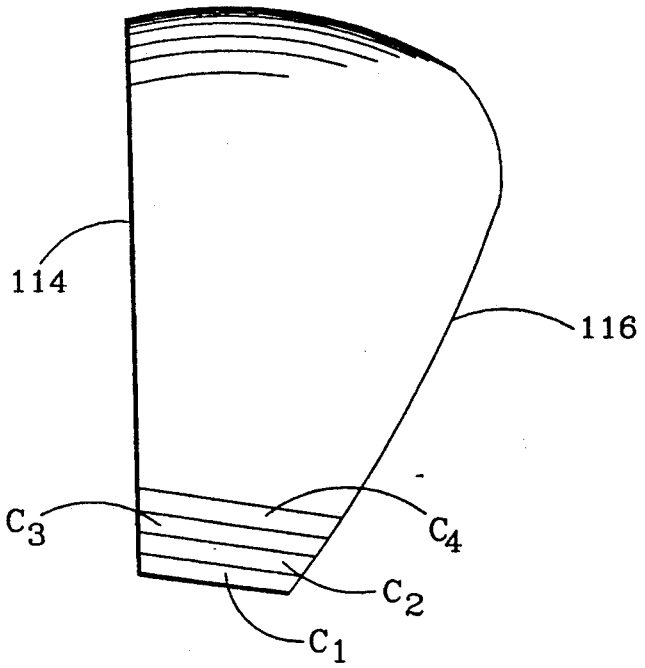
FIG. 23 is a front elevation of the blade.

Knowing the torque, T, from the above calculations, the area of the axial projection can be estimated. It is also known that small strips of blade area $C_1-C_n$ (FIG. 23) progressing radially along the blade must all have the same advance per revolution, regardless of radius. From this, the pitch angle $\phi$ (FIG. 21) of the blade at any radius may be calculated. Since the blade true area is inclined to the disk plane of the rotor, we can now determine the expanded area, for a small transverse strip at a given radius, that will satisfy both torque and thrust requirements, using $p_a$, the area of the axial projection, and radius, by iteration. One of several ways to do this is described as the "Blade Element Theory of Screw Propellers" in the aforementioned *Principles of Naval Architecture* beginning at page 377. These expanded strip areas are summed to give total expanded area. Also, knowing that one long edge is rectilinear, and using each strip area to derive the blade width at that radius, we can derive the expanded blade shape.

The strength of the rotor is determined using conventional structural beam theories taking into account the mechanical properties of the materials used and the distribution of fluid pressures. A phosphor bronze is a currently preferred material.

The above represent exemplary preferred embodiments, but numerous modifications are possible within the scope of the present invention. By way of example only, whereas the first embodiment includes channels only adjacent the stern, and the second embodiment includes some channels adjacent the stern and other channels adjacent the bow. Still other embodiments, particularly much longer vessels, might include a third set of channels intermediate the fore and aft channels. Also, at least some of the principles of the present invention could be applied to devices other than boat hulls for effecting relative movement of a flowable substance. For purposes of this specification, "flowable substances" will include not only fluids, but other substances which can be moved by a propeller or rotor. For example, granular materials or powders which are not so tightly packed as to prevent such movement would be considered "flowable substances" for present purposes.

Accordingly, it is intended that the scope of the present invention be limited only by the claims which follow.

What is claimed is:

1. A boat hull comprising:

a bow portion having an undersurface defined by a plurality of flat bow plates angularly joined at their edges to approximate a streamlined, convergent bow configuration;

an aft portion having an undersurface continuous with that of said bow portion;

at least two stern channel means extending longitudinally forward from respective stern corners adjacent respective sides of the hull, each having a top defined by said undersurface and inclined upwardly and rearwardly, a bottom plate spaced downwardly from the top and extending along the rearmost portion of the channel means, laterally inner and outer side plates interconnecting said top and said bottom plate to form a fully laterally enclosed core section of said channel means along the foremost part of said bottom plate, said side plates projecting forwardly of said bottom plate, lower edges of the projecting portions of said side plates being inclined upwardly and forwardly from the bottom plate to the undersurface to partially structurally define sides of said channel means, the outer side plate projecting forward a substantially greater distance than the inner side plate but spaced from said bow portion, and a rib depending downwardly from said top and extending longitudinally through the channel means from the fore end of the bottom plate to about the foremost part of the outer side plate, the aft end of said rib extending from said top to said bottom plate, said rib having a lower face inclined upwardly and forwardly to meet said top, and said rib being true with respect to the length of the boat.

2. The device of claim 1 wherein, as to each of said channel means, said side plates are parallel, located at the lateral extremities of said bottom plate, and the inner side plates are spaced forward from the aft end of said bottom plate;

and wherein each of said channel means further comprises a ring mounted in said core section with its centerline longitudinally of said hull, generally tangent to said undersurface and said bottom plate, spaced from said side plates, and spaced a relatively short distance from the fore end of said core section and a relatively greater distance from the rear end of said core section.

3. The device of claim 2 comprising intermediate such channel means disposed between said two channel means to span a major part of the breadth of said hull, said intermediate channel means being identical to said two channel means except that all their side plates' projecting portions are similar to the inner side plates of said two channel means, said bottom plates being continuous, and each pair of adjacent channel means having a common side plate.

4. The device of claim 2 comprising a pair of forward channel means located generally longitudinally between said bow portion and said stern channel means, and transversely between said stern channel means such that all said channel means cumulatively span a major part of the breadth of said hull;

said forward channel means having aft configurations which are generally mirror images of said stern channel means across a plane transverse to said hull except that their side plates' projecting portions are similar to the inner side plates of said stern channel means, they have a common side plate between them, their bottom plates are continuous, their side plates extend the full length of their bottom plates, and their rotors and rings are displaced forwardly;

and said forward channel means having ancillary forward structure comprising a forwardly converging upper extension of the tops of said forward channel means, a forwardly converging lower extension of said bottom plates, having side edges generally aligned with those of said upper extension, said lower extension being inclined upwardly and forwardly but not intersecting said upper extension;

and a forwardly projecting portion of said common side plate interconnecting said upper and lower extensions.

5. A boat comprising:

a hull having at leas a first channel means disposed lengthwise thereof and having open upstream and downstream ends and at least partially defining an elongate flow path, said first channel means including a fully laterally closed core section distal said upstream end and a transition section extending forward from the upstream end of said core section for a substantial part of the length of said first channel means; said flow path occupying a locus having a top, a bottom, and two opposed sides; the top of said locus being defined by a portion of an underside of said hull inclined upwardly and rearwardly; the bottom of said locus, in said core section, being defined by a bottom plate spaced below the undersurface of said hull, and along said transition section, being open; and the sides of said core section being defined by spaced apart side plates interconnecting said undersurface and said bottom plate, said side plates having portions projecting forwardly of said bottom plate, lower edges of the projecting portions of said side plates being inclined upwardly and forwardly from the bottom plate to the undersurface of the hull to partially structurally define the sides of said flow path locus upstream of said core section;

and a propulsion system including a fluid moving rotor rotatably mounted in said core section so as to cause downstream relative movement of water;

said first channel means and said rotor being adapted to permit a continual decrease in the transverse cross-sectional area of said flow path downstream along said transition section.

6. The device of claim 5 wherein said hull is longer than said channel means.

7. The device of claim 6 wherein said hull comprises a plurality of other channel means each with such a core section and a respective rotor therein, said channel means being arranged parallel to one another without substantial transverse overlapping.

8. The device of claim 7 wherein said channel means jointly span a major part of the breadth of said hull.

9. The device of claim 7 wherein each of said rotors is spaced downstream from the upstream end of the respective core section, and said channel means are so disposed and configured that, when said rotors are running and said hull is moving forward in water at a given speed, the core sections of said channel means immediately upstream of the respective rotors are self-pressurized.

10. The device of claim 9 wherein said channel means are aligned side by side generally adjacent the stern of said hull, said other channel means being similar in configuration to said first channel means; and said hull is of a relatively shallow type, said propulsion system being adapted to propel said boat at a sufficiently high speed to so pressurize said core sections of said channel means by a reverse venture effect.

11. The device of claim 9 wherein said first channel means and a second of said channel means are aligned generally adjacent the stern of said hull and disposed symmetrically across the centerline of said hull, said second channel means being similar in configuration to said first channel means; and at least a third of said channel means is disposed generally adjacent the bottom of said hull longitudinally offset from said first and second channel means; an open upstream end of said third channel means is disposed at a sufficient depth to so pressurize the respective core section of the third channel means at a speed which said propulsion system is adapted to impart to said boat; and said propulsion system is adapted to propel said boat at a sufficiently high speed to so pressurize the core sections of said first and second channel means by a reverse venture effect.

12. The device of claim 11 wherein there is a fourth of said channel means similar in configuration to said third channel means, said third and fourth channel means being aligned side by side intermediate the lateral sides of said hull, said first and second channel means being spaced apart by approximately the width of said third and fourth channel means and disposed adjacent respective sides of said hull.

13. The device of claim 9 wherein said hull has an interior primary usable space, and at least portions of said core sections immediately upstream of the respective rotors are disposed above the lowest part of said primary usable space.

14. The device of claim 5 wherein there are a plurality of other channel means in said boat hull each having such a core section and a respective rotor therein; a second of said channel means being disposed beside said first channel means, the bottom plate of said first channel means being continuous with the bottom plate of said second channel means and there being a common side plate at a juncture of said first and second channel means serving as one of the side plates of said first channel means as well as one of the side plates of said second channel means.

15. The device of claim 5 further comprising a ring within said core section, surrounding said rotor, open in fore and aft directions, and at least partially spaced from inner surfaces of said core section to define bypass flow spaces between said inner surfaces and said ring.

16. The device of claim 15 wherein said bottom plate extends rearwardly past the aft end of said core section generally to the stern of said hull, and said ring is shorter than said core section and spaced rearwardly from the forward end of said core section and forwardly, by a greater distance, from the aft end of said core section.

17. The device of claim 15 wherein said propulsion system further comprises an engine operatively connected to said rotor, and said rotor has a plurality of blades radiating from its axis of rotation, the blades being adapted to absorb the maximum power output of said engine.

18. The device of claim 17 wherein radially outer edges of said blades are deflected downstream.

19. The device of claim 18 wherein each blade is pitched to cause rearward relative movement of fluid so that said blade has a leading edge and a trailing edge, one of the edges being rectilinear, and the other curvilinear, and the leading edge being raked in the front-rear directional mode.

20. The device of claim 19 wherein the leading edge is rectilinear and is raked forwardly, and the trailing edge is curvilinear.

21. The device of claim 20 wherein a broad downstream surface of said blade is flat, and abroad upstream surface of said blade is convex.

22. The device of claim 21 wherein there are four such blades.

23. The device of claim 17 wherein said top is inclined upwardly and rearwardly.

24. The device of claim 5 wherein a bow portion of said hull forward of said channel means has an undersurface defined by a plurality of flat bow plates angularly joined at their edges to approximate a streamlined, convergent bow configuration.

25. The device of claim 24 wherein said propulsion system is operative to propel said boat at a speed which will produce gas lubrication over said bow portion by virtue of interaction of water with said bow plates and the angular joints therebeween.

26. The device of claim 25 wherein a portion of said hull aft of said bow portion has a main undersurface and a pair of outer side plates rigidly depending downwardly from said main undersurface adjacent the ides of the hull to retain lubricating gas adjacent said aft portion of said hull.

27. The device of claim 26 wherein there are at least two such channel means each having its core section at a respective stern side of said hull, each of said side plates forming a part of a respective one of said two channel means.

28. The device of claim 25 wherein most of said bow plates are four-sided and are so angularly disposed in both longitudinal and transverse planes.

29. The device of claim 28 wherein the sizes of said bow plates generally decrease rearwardly.

30. The device of claim 29 wherein said bow plates are sized to prevent failures at the joints between bow plate edges due to harmonic vibrations.

31. The device of claim 30 wherein said bow plates are sized and so angularly positioned as to provide lift generally taking into account the relationship:

$R_f = 0.025 s' v$ where $R_f$ = resistance $s'$ = wetted surface area $v$ = speed, and a stern portion of said hull has a main undersurface defining the top of said channel means and additional downwardly facing surfaces configured to provide aft lift generally according to said relationship balancing the bow lift provided by said bow plates.

32. The device of claim 31 wherein said channel means are adapted to contain a sufficient mass of water to resist longitudinal canting as said hull rises in motion.

33. The device of claim 30 wherein such interaction causes Coanda flow characteristics over said bow plates and the angles between said bow plates are sized to enhance the formation of separation zones downstream of the joints.

34. The device of claim 33 wherein, as to a majority of said bow plates, the acute angle between a plate and an extension of the next adjacent plate is less than or equal to 30°.

35. The device of claim 33 wherein said angles are further sized to decrease secondary impingement of water in motion.

36. The device of claim 24 wherein the interior of said hull is braced by intercostal construction means comprising elongate members disposed edgewise along the edges of said bow plates.

37. A boat comprising:

a hull having at least two channel means disposed lengthwise thereof and disposed symmetrically from each other across the centerline of the hull, adjacent respective sides thereof, said channel means being of similar configuration and each having open upstream and downstream ends and at least partially defining an elongate flow path, each channel means including a fully laterally closed core section adjacent the stern of the hull and a transition section extending forward from the upstream end of the core section for a substantial part of the length of the channel means, said flow path occupying a locus having a top, a bottom, and two opposed sides, the top of said locus being defined by a portion of an undersurface of said hull which comprises part of said channel means, the bottom of said locus, along said core section, being defined by a bottom plate spaced below said undersurface of said hull, and along said transition section being open, and the sides of said core section being defined by spaced apart side plates interconnecting said undersurface and said bottom plate, the side plates having portions projecting forwardly of the bottom plate, lower edges of the projecting portions of the side plates being inclined upwardly and forwardly from the bottom plate to the undersurface of the hull, and the outermost side plate of each channel means projecting forwardly a greater distance than the respective innermost side plate;

said hull further comprising at least two hollow ribs depending downwardly from said undersurface, each rib extending longitudinally along the transition section of a respective one of said channel means, generally midway between the sides of said channel means, each rib having a lower face, the aft end of which is disposed adjacent the fore end of the bottom plate of the respective channel means and which is inclined upwardly and forwardly, its fore end being joined to the undersurface, and the rib being true with respect to the length of the boat;

a propulsion system including a respective fluid moving rotor rotatably mounted in the core section of each of said channel means so as to cause downstream relative movement of water;

at least two drive shafts, each extending in a single straight line run from an engine in said hull above said undersurface, through a respective one of said hollow ribs to a respective one of the rotors;

said channel means and said rotors being adapted to permit a continual decrease in the transverse cross-sectional area of the respective flow paths downstream along the respective transition sections.

38. The device of claim 37 wherein the lower edges of said outermost side plates parallel the lower faces of the ribs of the respective channel means.

39. The device of claim 37 wherein a bow portion of said hull is configured to provide lift upon forward movement, said lower faces of said ribs being inclined at such an angle as to provide aft lift of a magnitude to generally balance said lift of the bow portion.

40. The device of claim 30 wherein said bottom plates are approximately straight horizontal.

41. The device of claim 40 wherein said bottom plates are sized to contain a sufficient mass of water to resist longitudinal canting as said hull rises in motion.

42. The device of claim 38 wherein the sides of said hull have downwardly facing steps running longitudinally adjacent the tops of those channel means aligned adjacent the stern, the steps providing additional balancing lift.

43. The device of claim 35 wherein said hull lacks a keel.

44. The device of claim 43 wherein the interior of said hull is braced by intercostal construction means.

45. The device of claim 38 further comprising other channel means offset forwardly from said two channel means and having respective ribs extending rearwardly from core sections thereof.

* * * * *

UNITED STATES PATENT AND TRADEMARK OFFICE

CERTIFICATE OF CORRECTION

PATENT NO. : 5,205,765

DATED : April 27, 1993

INVENTOR(S) : Joseph T. Holden

It is certified that error appears in the above-identified patent and that said Letters Patent is hereby corrected as shown below:

In Column 21, line 61, kindly change "ides" to --sides--.

Signed and Sealed this

Fourteenth Day of December, 1993

*Attest:*

Bruce Lehman

BRUCE LEHMAN

*Attesting Officer*

*Commissioner of Patents and Trademarks*